US010151511B2

(12) United States Patent
Chaudhry et al.

(10) Patent No.: US 10,151,511 B2
(45) **Date of Patent: *Dec. 11, 2018**

(54) ELECTRIC WATER HEATER HAVING DRY FIRE PROTECTION CAPABILITY

(71) Applicant: Rheem Manufacturing Company, Atlanta, GA (US)

(72) Inventors: Raheel A. Chaudhry, Montgomery, AL (US); Arthur Y. Hinton, Pike Road, AL (US)

(73) Assignee: RHEEM MANUFACTURING COMPANY, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/877,265

(22) Filed: Jan. 22, 2018

(65) Prior Publication Data

US 2018/0142921 A1 May 24, 2018

Related U.S. Application Data

(62) Division of application No. 14/735,972, filed on Jun. 10, 2015, now Pat. No. 9,874,375.

(51) Int. Cl.

| | |
|---|---|
| ***H05B 1/02*** | (2006.01) |
| ***F24H 9/20*** | (2006.01) |
| ***F24H 1/00*** | (2006.01) |
| ***F24H 1/20*** | (2006.01) |
| *F24H 9/18* | (2006.01) |

(52) U.S. Cl.

CPC ..... *F24H 9/2021* (2013.01); *F24H 1/0018* (2013.01); *F24H 1/202* (2013.01); *F24H 9/1818* (2013.01)

(58) Field of Classification Search

CPC ..... H05B 1/0245; H05B 1/02; H05B 3/0052; F24H 9/2021; F24K 1/0018

USPC ..... 219/481, 497, 492, 483–487

See application file for complete search history.

(56) References Cited

U.S. PATENT DOCUMENTS

| | | | | |
|---|---|---|---|---|
| 5,923,819 | A | 7/1999 | Ross et al. | |
| 6,308,009 | B1 * | 10/2001 | Shellenberger | F24H 9/2021 392/454 |
| 7,099,572 | B2 * | 8/2006 | Phillips | F24H 9/1818 392/449 |
| 8,126,320 | B2 | 2/2012 | Cartwright | |

(Continued)

OTHER PUBLICATIONS

Canadian Office Action dated Jun. 13, 2017, for corresponding Application No. 2,932,984.

(Continued)

*Primary Examiner* — Mark Paschall

(74) *Attorney, Agent, or Firm* — King & Spalding LLP

(57) ABSTRACT

A water heater has a tank defining an interior volume, a heating element disposed within the interior volume, and a temperature sensor disposed with respect to the heating element so that the temperature sensor detects temperature of an area ambient to the heating element in the interior volume. The heating element is actuated at a predetermined actuation rate and for a cumulative actuation period so that the predetermined actuation rate maintains the heating element below a predetermined maximum temperature in air and so that the actuation period contributes a predetermined amount of energy to the ambient area when the heating element is immersed in water.

16 Claims, 7 Drawing Sheets

(56) References Cited

U.S. PATENT DOCUMENTS

| | | | | |
|---|---|---|---|---|
| 8,887,671 | B2 * | 11/2014 | Patterson | F24H 9/2014 122/4 A |
| 9,874,375 | B2 * | 1/2018 | Chaudhry | F24H 1/0018 |
| 2004/0161227 | A1 | 8/2004 | Baxter | |
| 2007/0210067 | A1 | 9/2007 | Patterson et al. | |
| 2010/0206869 | A1 | 8/2010 | Nelson | |

OTHER PUBLICATIONS

Australian Examination Report dated Mar. 3, 2017, for corresponding Application No. 2016203836.

* cited by examiner

ELECTRIC WATER HEATER HAVING DRY FIRE PROTECTION CAPABILITY

RELATED APPLICATIONS

The present application is a divisional application of and claims priority to U.S. patent application Ser. No. 14/735,972, filed Jun. 10, 2015, and titled "Electric Water Heater Having Dry Fire Protection Capability," the entire contents of which are hereby incorporated herein by reference.

FIELD OF THE INVENTION

The present invention relates generally to a system and method for detecting and preventing dry fire events in water heaters.

BACKGROUND OF THE INVENTION

Electric water heaters are used to heat and store a quantity of water in a storage tank for subsequent on-demand delivery to plumbing fixtures such as sinks, bathtubs and showers in both residences and commercial buildings. Electric water heaters typically utilize one or more electric resistance heating elements to supply heat to the tank-stored water under the control of a thermostat which monitors the temperature of the stored water.

An electric water heater is sold without water in its tank and is filled with water after it is moved to and installed in its intended operative location. The possibility exists that the water heater can be "dry fired," i.e., have its electric resistance type heating elements energized before the storage tank is filled with water (thereby immersing the elements in the water) or otherwise in a condition in which the heating elements are not covered in water. When such dry firing occurs, the electric resistance heating elements may overheat, which may result in returning the unit to the manufacturer, or a service call by a repair technician to perform an on-site element replacement. As well, in those water heaters including bodies formed by plastic materials, damage to the body from excessive heat can render the water heater unrepairable.

Various solutions have previously been proposed to prevent energizing heating elements in electric water heaters unless the elements are immersed in water. These proposed solutions have taken two forms, float switch-based protective systems, in which the heating elements are activated only if a float sensor detects a water level in the tank above a certain level sufficient to cover the heating elements, and temperature sensor-based protective systems, in which the heating elements are activated only if a temperature sensor in contact with an outer surface of the water heater adjacent a corresponding heating element indicates a temperature below a predetermined threshold. Float switch-based systems, however, tend to be complex and costly to incorporate into the overall water heater assembly and include moving parts that can adversely affect reliability. Existing temperature sensor-based protective systems may be unreliable with regard to water heaters having tanks constructed of polymer materials, in that where the polymers are poor conductors of heat, damage may occur to the tank before the temperature sensor detects a dry fire condition.

SUMMARY OF THE INVENTION

The present invention recognizes and addresses considerations of prior art constructions and methods.

In one embodiment of the present disclosure, a water heater has a tank that defines an interior volume, a heating element disposed within the interior volume, a temperature sensor disposed with respect to the heating element so that the temperature sensor detects temperature of an area ambient to the heating element in the interior volume, and a controller in communication with the temperature sensor. The controller is configured to actuate the heating element at a predetermined actuation rate and for a cumulative actuation period so that the predetermined actuation rate maintains the heating element below a predetermined maximum temperature in air and so that upon conclusion of the cumulative actuation period, the heating element contributes at least a predetermined amount of energy to the area that is measurable by the temperature sensor when the heating element is immersed in water.

In another embodiment, the controller is configured to receive a first signal from the temperature sensor indicating temperature of the ambient area and determine a first temperature based on the first signal. After determining the first temperature, the controller intermittently actuates the heating element for a predetermined cumulative actuation period. After the predetermined cumulative actuation period, the controller receives a second signal from the temperature sensor indicating temperature of the ambient area and determines a second temperature based on the second signal. The controller disables the heating element if the second temperature exceeds the first temperature beyond a first predetermined increment.

In another embodiment, a water heater includes a tank that defines an interior volume, a heating element disposed within the interior volume, a temperature sensor disposed with respect to the heating element so that the temperature sensor detects temperature of an area ambient to the heating element in the interior volume, and a controller in communication with the temperature sensor. The controller is configured to, upon detecting a condition for actuating the heating element, receive a first signal from the temperature sensor indicating temperature of the ambient area and determine a first temperature based on the first signal. After determining the first temperature, the controller actuates the heating element for a cumulative actuation period sufficient to heat water ambient to the heating element by at least a predetermined increment and separates periods of actuation of the heating element within the cumulative actuation period by respective inactive periods of the heating element sufficient to maintain the heating element below a predetermined maximum temperature. After the predetermined cumulative actuation period, the controller receives a second signal from the temperature sensor indicating temperature of the ambient area and determines a second temperature based on the second signal. The controller disables the heating element if the second temperature exceeds the first temperature beyond a threshold corresponding to the predetermined increment and actuates the heating element in response to the condition if the second temperature does not exceed the first temperature beyond a threshold corresponding to the predetermined increment.

In an embodiment of a method of detecting a dry fire event in a water heater, the water heater has a tank defining an interior volume, a heating element disposed within the interior volume, and a temperature sensor disposed with respect to the heating element so that the temperature sensor detects temperature of an area ambient to the heating element in the interior volume. The heating element is actuated at a predetermined actuation rate and for a cumulative actuation period so that the predetermined actuation rate maintains the heating element below a predetermined maximum temperature in air and so that upon conclusion of the cumulative actuation period, the heating element contributes at least a predetermined amount of energy to the area that is measurable by the temperature sensor when the heating element is immersed in water.

In a further embodiment, a first temperature of the ambient area is detected. After detecting the first temperature, the heating element is intermittently actuated for a predetermined cumulative actuation period. After the predetermined cumulative actuation period, a second temperature of the ambient area is determined. The heating element is disabled if the second temperature exceeds the first temperature beyond a first predetermined increment.

In a still further embodiment of a method of detecting a dry fire event in a water heater having a tank defining an interior volume, a heating element disposed within the interior volume, and a temperature sensor disposed with respect to the heating element so that the temperature sensor detects temperature of an area ambient to the heating element in the interior volume, a first temperature of the ambient area is detected upon occurrence of a condition for actuating the heating element. After detecting the first temperature, the heating element is actuated for a predetermined cumulative actuation period sufficient to heat water ambient to the heating element by at least a predetermined increment. Periods of actuation of the heating element within the cumulative actuation period are separated by respective inactive periods of the heating element sufficient to maintain the heating element below a predetermined maximum temperature. After the predetermined cumulative actuation period, a second temperature of the ambient area is determined. The heating element is disabled if the second temperature exceeds the first temperature beyond a first predetermined increment and actuated in response to the condition if the second temperature does not exceed the first temperature beyond a threshold corresponding to the predetermined increment.

In an embodiment of a method of detecting a dry fire event in a water heater including a heating element, a first temperature within the water heater is determined prior to energizing the heating element. The heating element is intermittently energized for a plurality of first predetermined time periods separated by respective second predetermined time periods during which the heating element is inactive. A total number of first predetermined time periods for which the heating element has been energized is determined. The total number of first predetermined time periods is compared to a predetermined number of first predetermined time periods. When the total number of first predetermined time periods is greater than or equal to the predetermined number of first predetermined time periods, a second temperature within the water heater is determined. The second temperature is compared to the first temperature. The supply of power to the heating element is prevented when the second temperature is equal to or greater than the first temperature by at least a predetermined temperature increment.

In another embodiment of the present disclosure, a system for detecting a dry fire event in a water heater including a heating element has a temperature sensor element disposed adjacent the heating element, and a controller. The controller is configured to determine a first temperature within the water heater based on a signal from the temperature sensor element prior to energizing the heating element. The controller intermittently energizes the heating element for a plurality of first predetermined time periods. The controller determines a total number of first predetermined time periods for which the heating element has been energized. The controller compares the total number of first predetermined time periods to a predetermined number of first predetermined time periods. The controller determines a second temperature within the water heater based on a signal from the temperature sensor element when the total number of first predetermined time periods is greater than or equal to the predetermined number of first predetermined time periods. The controller compares the second temperature to the first temperature and prevents the supply of power to the heating element when the second temperature is equal to or greater than the first temperature by at least a predetermined temperature increment.

The accompanying drawings, which are incorporated in and constitute apart of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended drawings, in which.

Figure 1:
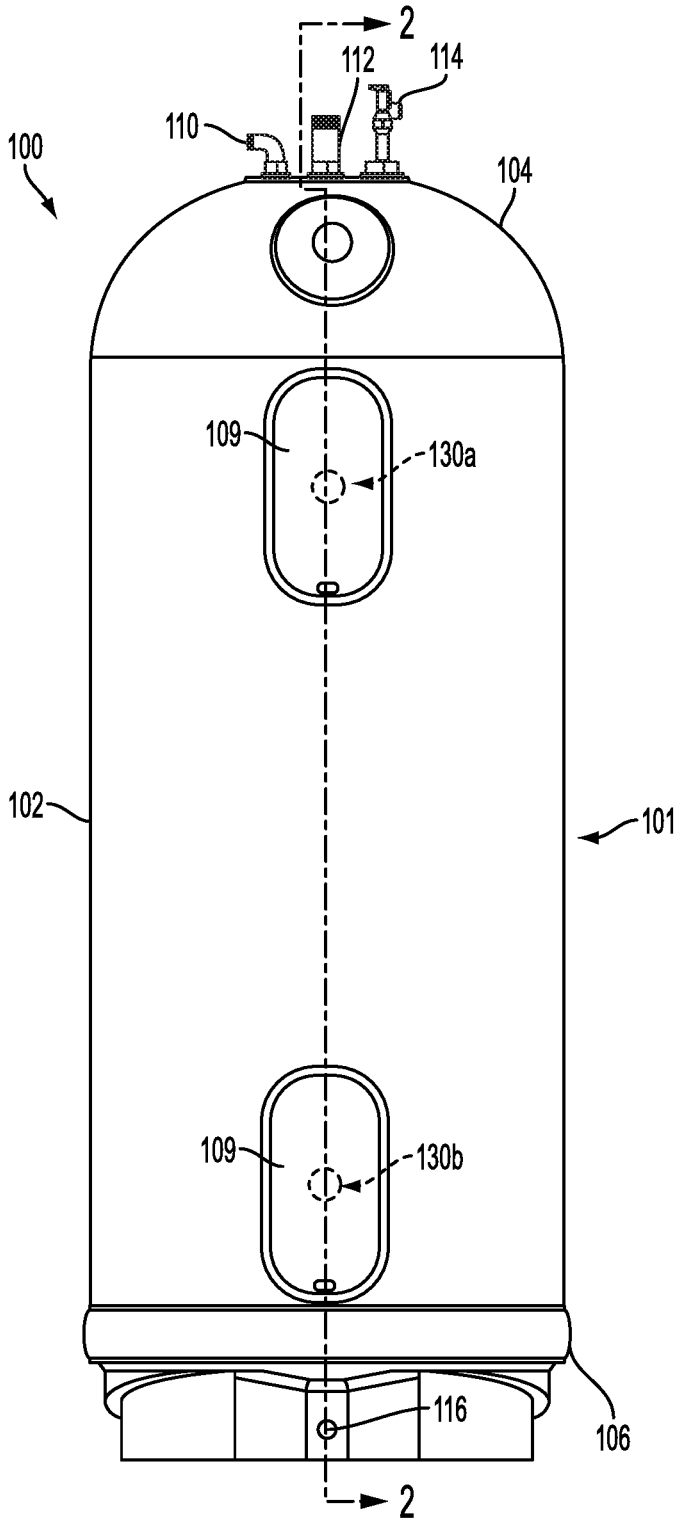
FIG. 1 is a front view of a water heater including a dry fire protection system in accordance with an embodiment of the present invention.

Repeat use of reference characters in the present specification and drawings is intended to represent same or analogous features or elements of the invention according to the disclosure.

DETAILED DESCRIPTION OF THE PREFERRED EMBODIMENTS

Reference will now be made in detail to presently preferred embodiments of the invention, one or more examples of which are illustrated in the accompanying drawings. Each example is provided by way of explanation, not limitation, of the invention. In fact, it will be apparent to those skilled in the art that modifications and variations can be made in the present invention without departing from the scope and spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2:
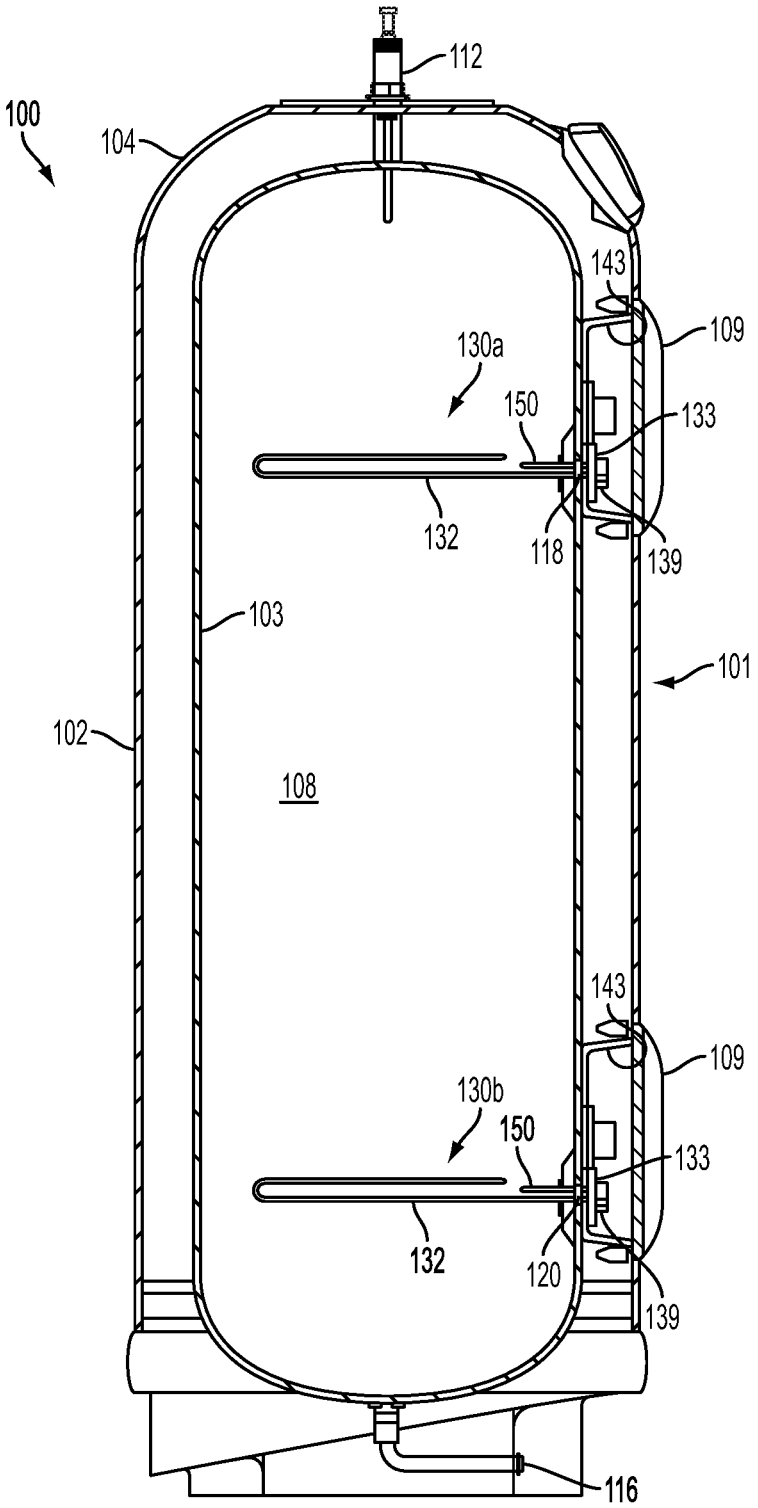
FIG. 2 is a cross-sectional view of the water heater shown in FIG. 1, taken along line 2-2.
Figure 3:
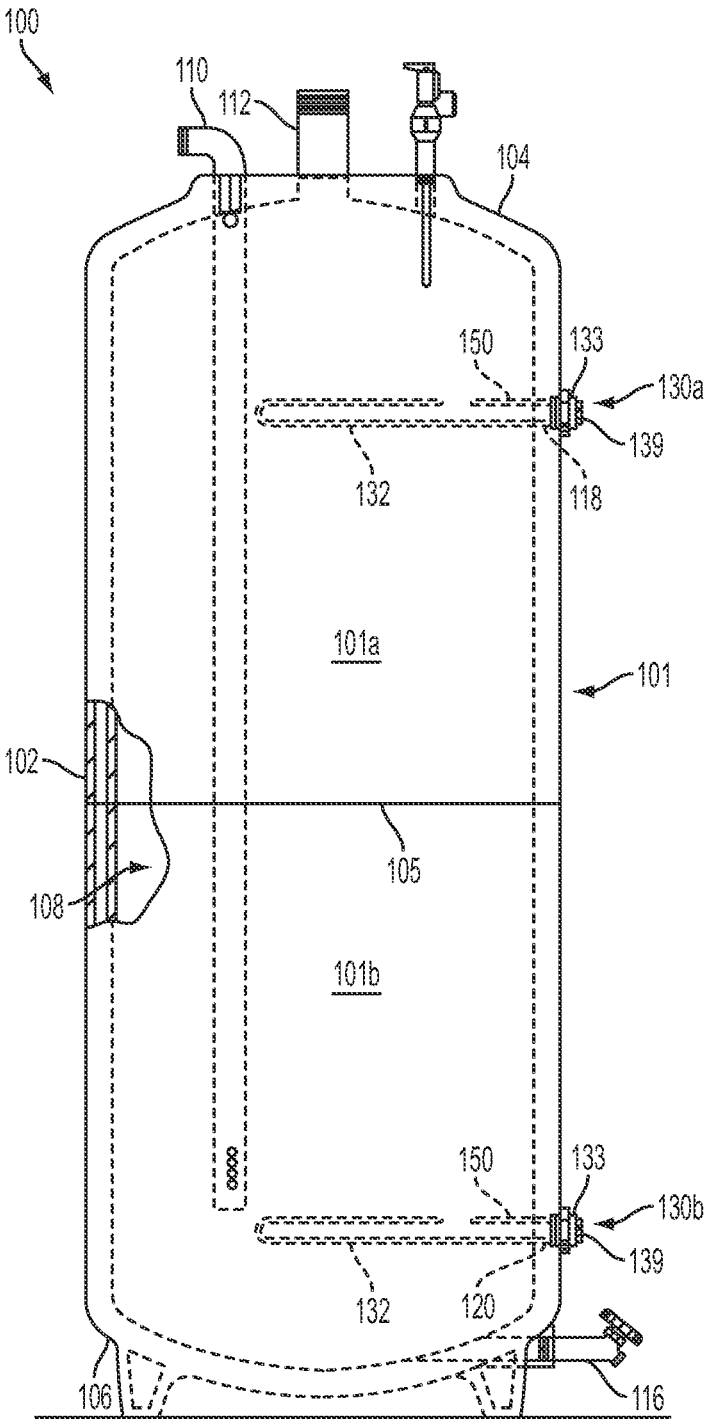
FIG. 3 is a side view of an embodiment of a water heater with a dry-fire protection system in accordance with the present invention, including a partial cut-away view of the side wall.

As used herein, terms referring to a direction, or a position relative to the orientation of the water heater, such as but not limited to "vertical," "horizontal," "upper," "lower," "above," or "below," refer to directions and relative positions with respect to the water heater's orientation in its normal intended operation, as indicated in FIGS. 1 through 3 herein. Thus, for instance, the terms "vertical" and "upper" refer to the vertical orientation and relative upper position in the perspective of FIGS. 1 through 3, and should be understood in that context, even with respect to a water heater that may be disposed in a different orientation.

Further, the term "or" as used in this application and the appended claims is intended to mean an inclusive "or" rather than an exclusive "or." That is, unless specified otherwise, or clear from the context, the phrase "X employs A or B" is intended to mean any of the natural inclusive permutations. That is, the phrase "X employs A or B" is satisfied by any of the following instances: X employs A; X employs B; or X employs both A and B. In addition, the articles "a" and "an" as used in this application and the appended claims should generally be construed to mean "one or more" unless specified otherwise or clear from the context to be directed to a singular form. Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

Referring now to FIGS. 1 and 2, a water heater 100 includes a system for detecting dry fire events in accordance with the present disclosure. Water heater 100 includes a vertically oriented, generally cylindrical body 101 that is defined by an outer wall having a domed top head portion 104, a bottom pan portion 106, a generally cylindrical side wall 102 extending therebetween and having an annular cross-section in a plane normal to the body's cylindrical center axis, and a seamless, one-piece liner 103 disposed therein that defines an interior volume 108 for receiving and holding water. As shown, side wall 102 is formed of a reinforced polypropylene-based polymer material, but it will be understood from the present disclosure that in other embodiments, other suitable polymer materials may be utilized, as well as steel or other metals, for sidewall 102, head 104, and pan 106. As should also be apparent from the present disclosure, the wall's construction and configuration may also vary, and the present disclosure is not limited to the constructions of the specific examples discussed herein. In another embodiment, for example, and referring to FIG. 3, body 101 is formed of upper and lower body portions 101*a* and 101*b* that are independently molded and later joined at a seam 105. Body portions 101*a* and 101*b* are formed of a double walled construction, rather than the wall-and-bladder arrangement illustrated in the embodiment of FIG. 2. The process by which body portions 101*a* and 101*b* are manufactured is discussed in greater detail in U.S. Pat. No. 5,923,819, issued Jul. 13, 1999, the entire contents of which are incorporated herein by reference, and a detailed description of the process is therefore not repeated herein.

As shown in FIGS. 1 and 2, a cold water inlet pipe 110, a hot water outlet fitting 112 and a temperature and pressure release valve 114 extend through suitable openings defined in the water heater's domed top head portion 104. A valve drain pipe 116 extends inwardly through bottom pan portion 106. A pair of top and bottom vertically spaced electric resistant heating assemblies 130*a* and 130*b* (see FIG. 2) extend radially inwardly into interior volume 108 through a pair of corresponding top and bottom apertures 118 and 120 that are formed in respective recessed housings 143 that are disposed and extend between liner 103 and side wall 102 of the water heater's body 101. Housings 143 include or cooperate with respective covers 109 (FIG. 1) that cover electrical fittings 139 (FIGS. 4A and 4B) of electric resistance heating assemblies 130*a* and 130*b* and extend outwardly from the side wall of water heater 100. A power source provides electric current to respective heating elements of assemblies 130*a* and 130*b* via electrical fittings 139, and a control board communicates with respective temperature sensors (150/152) of assemblies 130*a* and 130*b* via electrical fittings 139, as described below.

During typical operations of water heater 100, cold water from a pressurized source flows into water heater interior volume 108, wherein the water is heated by electric resistance heating assemblies 130*a* and 130*b* and stored for later use. When plumbing fixtures (not shown) to which water heater 100 is connected within a building or other facility within which water heater 100 is installed require hot water and are actuated to allow flow of hot water from the tank via fitting 112, the stored, heated water within interior volume 108 of water heater 100 flows outwardly through hot water outlet fitting 112 to the fixtures by way of hot water supply piping (not shown) as should be understood in this art. The discharge of heated water outwardly through hot water outlet fitting 112 creates capacity within volume 108 that is correspondingly filled by pressurized cold water that flows downwardly through cold water inlet pipe 110 and into volume 108. This lowers the temperature of water in the tank, which is in turn heated by electric resistance heating assemblies 130*a* and 130*b*. A control board processor (described below) monitors temperature of water in the tank based on a signal received from a temperature sensor 150 (discussed below) of upper heating assembly 130*a*, actuating the heating elements of assemblies 130*a* and 130*b* when the processor detects a water temperature below a predetermined low threshold value and maintaining the heating elements in an actuated state until the processor detects water temperature above a predetermined high threshold value, where the high threshold is greater than the low threshold as should be understood. While in the present example the control system relies upon the temperature sensor (150) utilized in the heating element assembly, it should be understood that this is for purposes of example only and that the control system may include a separate temperature sensor for this purpose.

Figure 4A:
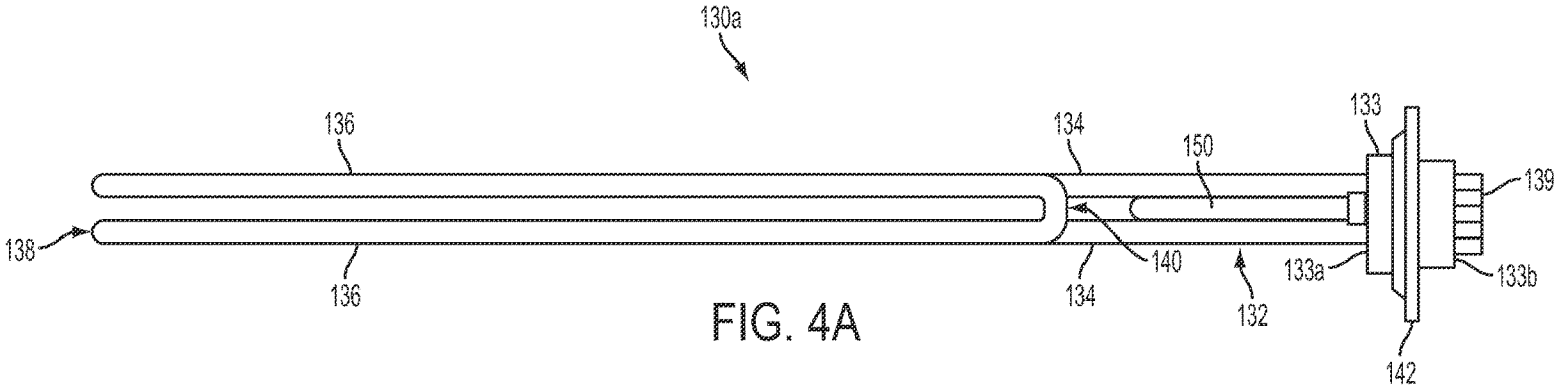
FIGS. 4A and 4B are top and side views, respectively, of an electric heating element of the water heater shown in FIG. 1.
Figure 4B:
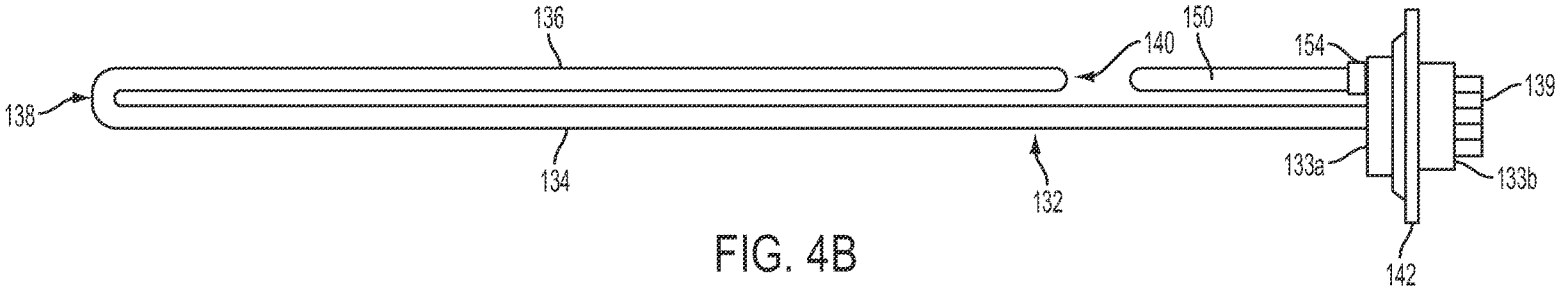

FIGS. 4A and 4B provide top and side views of top electric resistance heating assembly 130*a*. In the presently described embodiments, top and bottom electric resistance heating assemblies 130*a* and 130*b* are identical but, in other embodiments, may differ in their construction. In another embodiment, for example, and as discussed herein, upper heating assembly 130*a* has a temperature sensor, but lower heating assembly 130*b* does not. Still further, in other embodiments, only one heating assembly is used in the water heater, it having a temperature sensor as discussed herein. Where the water heater has only one heating assembly, the heating assembly may be located lower in the tank, generally in the position of assembly 130*b* in FIG. 2. As will also be apparent from the present disclosure, the water heater may utilize more than two heating assemblies.

Electric resistance heating assembly 130*a* includes an electric resistance heating element 132 and a temperature sensor probe 150, each extending outwardly from a first side 133*a* of a cylindrically-shaped base portion or harness 133 (and inwardly into tank interior volume 108 when the heating assembly is installed in the water heater). Electric resistance heating element 132 includes a pair of horizontally-spaced, parallel bottom leg portions 134 and a pair of horizontally-spaced, parallel top leg portions 136. Each bottom leg portion 134 is both parallel to, and connected to, a corresponding top leg portion 136 by a 180 degree first bend portion 138, as seen in FIG. 4B. Additionally, as seen in FIG. 4A, the distal ends of top leg portions 136 are connected by a 180 degree second bend portion 140. Top leg portions 136 are shorter than bottom leg portions 134, meaning that second bend portion 140 is horizontally spaced or offset (in the perspective of FIG. 4B and FIG. 2) from base portion 133 of electric resistance heating element 132. In the previously described embodiments, electric resistance heating element 132 is formed from titanium. However, in alternate embodiments, the heating elements may be formed from other suitable materials, e.g. copper. The construction of the heating element itself can vary, as should be understood in view of the present disclosure. Moreover, the structure and operation of electric resistance heating elements should be well understood and are not, therefore, discussed in further detail herein.

Figure 5:
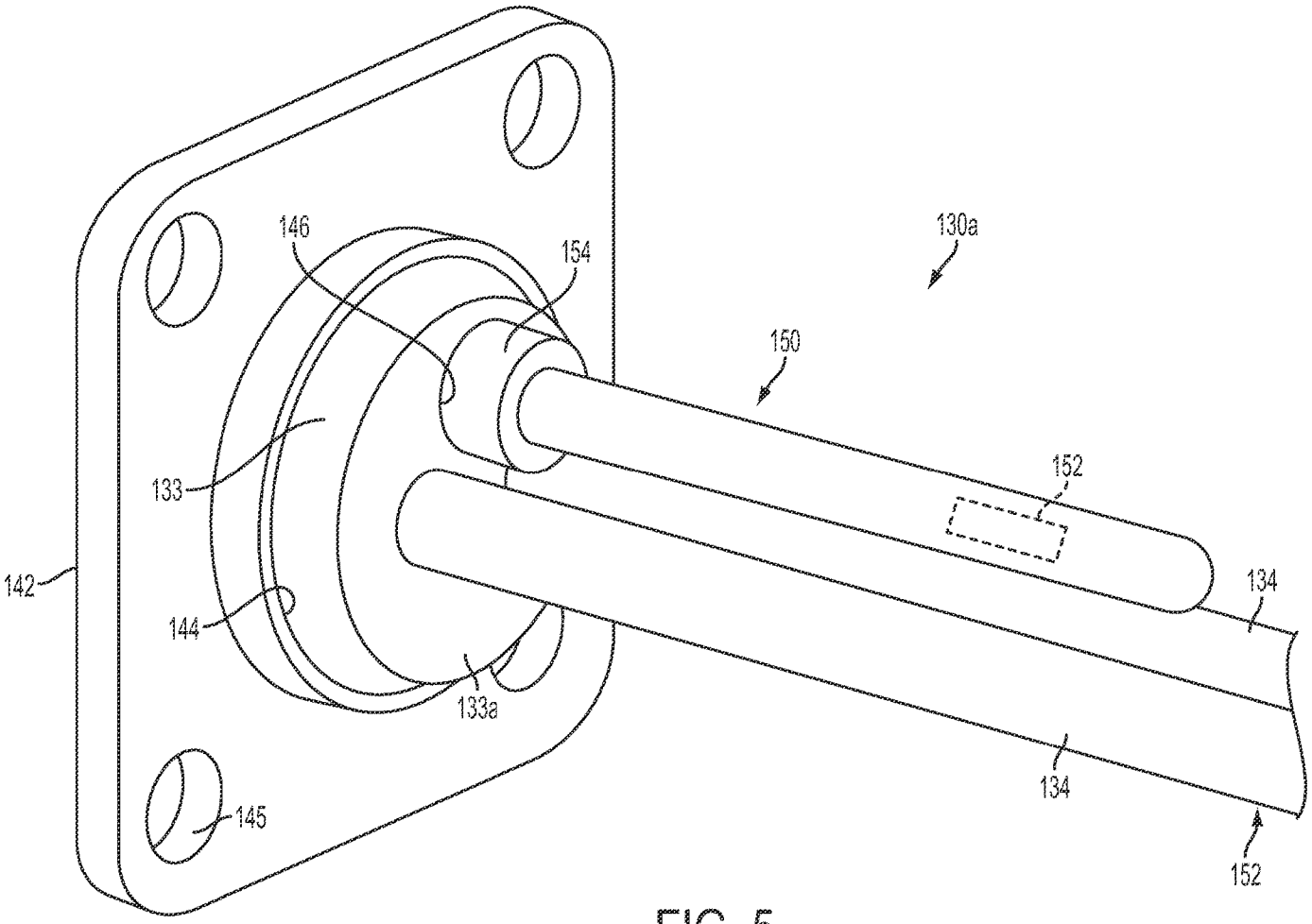
FIG. 5 is a perspective view of a base portion of the electric heater element shown in FIGS. 4A and 4B.

Temperature sensor probe 150 extends outwardly from first side 133*a* of base portion 133 toward second bend portion 140. When the element is installed in water heater 100, so that body 101 is oriented so that its longitudinal axis is vertical as shown in the perspective of FIGS. 1 and 2, temperature sensor probe 150 is positioned horizontally between, and vertically above, heating element bottom leg portions 134 such that sensor probe 150 is parallel to both bottom and top leg portions 134 and 136. Referring also to FIG. 5, temperature sensor probe 150 includes a thermistor element 152 disposed therein and extends from a threaded base 154, the threaded base 154 being received in a correspondingly threaded aperture 146 defined in base portion 133 of electric resistance heating assembly 130*a*. Similarly, base portion 133 is threaded and received in a correspondingly threaded aperture 144 of a base flange 142, as seen in FIG. 5. Base flange 142 is utilized to affix electric resistance heating assembly 130*a* within top aperture 118 of the water heater's body 101 (and, more specifically, housing 143 at liner 103). As shown, base flange 142 is preferably affixed by plurality of fasteners, such as threaded fasteners (not shown), to a respective one of the recess housings 143 (FIG. 2) that is attached to and extends inward from tank outer wall 102 to liner 103 of body 101. The threaded fasteners are received through fastener apertures 145 of base flange 142. In alternate embodiments, threaded base portion 133 may be received directly in a correspondingly threaded aperture formed in annular side wall 102 of water heater 100. Electrical fittings 139 extend outwardly from a second side 133*b* of the heating assemblies base portion 133 so that the heating assembly may be connected to the associated power source and the temperature sensor probe electrically connected (via suitable wiring between thermistor element 152 and electrical fitting 139 and between electrical fitting 139 and controller 202) to controller 202. Note, in alternate embodiments, temperature detectors such as, but not limited to, thermocouples, resistance temperature detectors (RTDs), etc., may be used rather than thermistors to determine temperature within the water heater.

Figure 6:
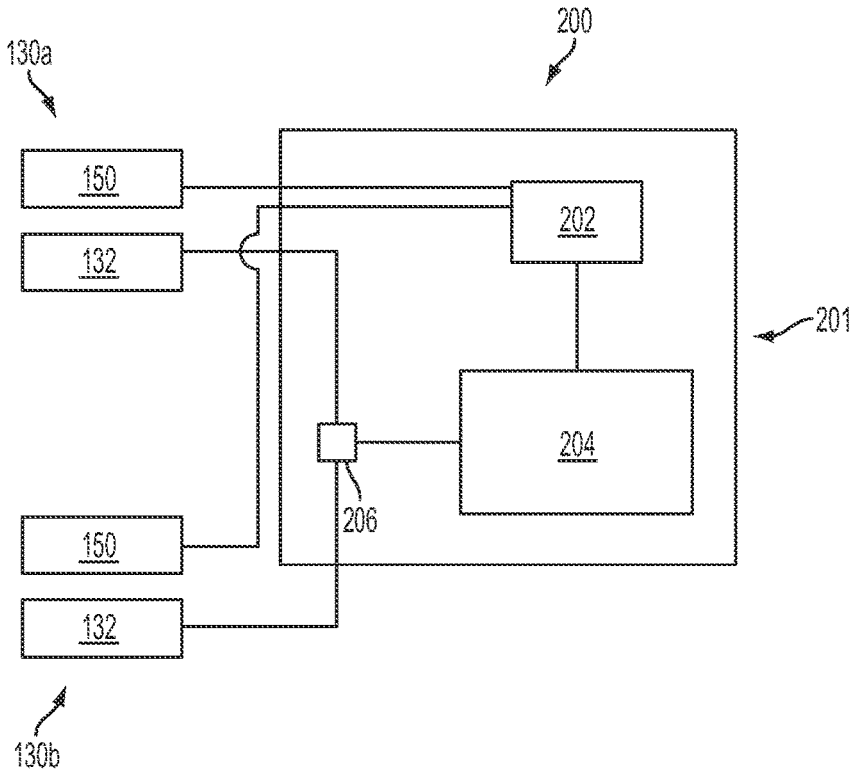
FIG. 6 is a schematic illustration of a dry fire protection control system as used with the water heaters of FIGS. 1-3.

As noted, electric water heaters are sold without water in their interior volumes and are filled after installation. The possibility exists that one or more of the water heater's electric resistance heating assemblies may be inadvertently energized before the water heater is filled or when it is otherwise inadvertently empty, leaving the electric resistance heating assemblies exposed to ullage air rather than being immersed in water. Without water being present to more effectively (than air) dissipate heat from the heating assemblies, operation of the heating assemblies in such dry firing conditions can result in the heating assemblies being damaged due to overheating and/or in damage to the water heater body, which in the instant example is formed of polypropylene-based polymer material. In addition to possible conditions occurring at installation, dry firing conditions may also exist where water is inadvertently drained from the water heater after installation. Accordingly, as shown in FIG. 6, water heater 100 (FIGS. 1 through 3) includes a dry fire protection system 200 in accordance with an embodiment of the present invention.

Dry fire protection system 200 includes a controller 202 that receives power from an associated power supply 204, and one or more temperature sensor probes 150, each being associated with a corresponding electric resistance heating assembly 130*a* and 130*b*. The controller illustrated in FIG. 6 is, in the illustrated embodiments, the same controller that controls the operation of the water heater, and the controller, power source, and switching unit 206 as indicated at 201 may be housed on the water heater's main control board. Thus, the functionality disclosed herein may be effected by programming the water heater's existing controller, although it should be understood that a separate processor may be used. As noted, the switch 206 and other circuitry indicated at FIG. 6 may be housed on the water heater's main control board or otherwise incorporated within the heater's existing control and power circuitry.

It will be understood from the present disclosure that the functions ascribed to controller 202 may be embodied by computer-executable instructions of a program that executes on one or more computers and its or their associated memory or other computer readable media, for example as embodied by the water heater's general embedded control system as described above. Generally, program modules include routines, programs, components, data structures, etc., that perform particular tasks and/or implement particular abstract data types. Moreover, those skilled in the art will appreciate that the systems/methods described herein may be practiced with various controller configurations, including programmable logic controllers, simple logic circuits, single-processor or multi-processor systems, as well as microprocessor-based or programmable consumer or industrial electronics, and the like. Aspects of these functions may also be practiced in distributed computing environments, for example in so-called "smart home" arrangements and systems, where tasks are performed by remote processing devices that are linked through a local or wide area communications network to the components otherwise illustrated in the Figures. In a distributed computing environment, programming modules may be located in both local and remote memory storage devices. Thus, control system 200 may comprise a computing device that communicates with the system components described herein via hard wire or wireless local or remote networks.

A controller that could affect the functions described herein could include a processing unit, a system memory and a system bus. The system bus couples the system components including, but not limited to, system memory to the processing unit. The processing unit can be any of various available programmable devices, including microprocessors, and it is to be appreciated that dual microprocessors, multi-core and other multi-processor architectures can be employed as the processing unit.

Power source 204 includes line electric current from the building or other location at which water heater 100 is installed, but also includes power control circuitry at the water heater's main control board, as should be understood in this art. In addition to providing power to controller 202, power supply 204 selectively provides power to electric resistance heating assemblies 130*a* and 130*b* by way of a switching unit 206, which may comprise an electromechanical or solid state relay and the operational status of which is controlled by an input from controller 202, as discussed in greater detail below.

In one embodiment, a test to detect whether dry-fire conditions exist within the water heater involves actuating the upper heating assembly 130*a* in a manner that satisfies two conditions. First, the system actuates heating assembly 130*a* so that, in the event the heating element is immersed in water, the heating assembly conveys an amount of heat to a surrounding water mass that is sufficient to change a temperature of the water mass in an area ambient to heating element 132 by an increment that is reliably consistent and measurable. Because the heat transfer characteristics between the heating element and water are known, and are different from the heat transfer characteristics between the heating element and tank ullage air, detection of the predetermined temperature change in the area ambient to the heating element following the heating element's actuation indicates the presence of water in the ambient area, i.e. that the heating element is immersed in water. That is, the heating element's actuation during the test period conveys heat to the area ambient to the heating element. Because water and ullage air draw heat from the heating element at different rates, and because the respective heat transfers to air and water are predictable or determinable through calibration testing, measurement of the ambient area temperature before and after the heating element's test period actuation provides sufficient information by which to differentiate between conditions in which the heating element is immersed in water or exposed to ullage air. Because water draws heat away from the heating element more efficiently than does ullage air, however, the heating element's actuation for a time sufficient to cause the heating element to convey the sufficiently measurable amount of heat to a surrounding water mass in an immersed state may cause the heating element, if not water-immersed (and thereby exposed to ullage air), to reach an excessively high temperature. This, in turn, may cause an undesirable conduction of heat to the water tank wall through the ullage air and through heating assembly housing. Accordingly, the second condition of this example of the present system is that the heating element's actuation should not cause heating of ambient ullage air and of the heating element, when exposed to ullage air, to a point at which an undesirable level of heat is conducted to the tank wall.

The example system described herein meets the two conditions by heating the heating element(s) sufficiently to raise the temperature of surrounding water by a measurable and predictably consistent increment but doing so at a rate sufficiently low that the heating element(s) does/do not overheat in the event the element(s) is/are surrounded by ullage air rather than water. In one embodiment, the desired low rate of heating is achieved by actuating the heating element(s) intermittently over a test period. The system measures starting and ending temperatures in an area adjacent the heating element(s) within the water tank respectively before and after actuation of the water heater's heating element(s) over the test period, but within the test period actuates the heating element(s) in intermittent periods. The sum of the intermittently active periods is sufficient to allow the heating element(s) to provide an amount of energy (as indicated by a temperature differential, as described below) to a water mass in the area ambient the heating element that, in the event the heating element is immersed in water, is sufficient to change the water mass' s temperature by the desired (reliably consistent and measurable) temperature increment. The heating element's intermittently actuated periods are separated, however, by respective inactive periods of duration and frequency sufficient to allow the heating element and ullage air to cool and thereby maintain below a temperature during the test period that, if the heating element is exposed to ullage air, might cause damage to the heating element or the water tank. That is, the intermittent inactive periods allow the heating element and ambient air to cool between the intermittent active periods to a desirable degree if the heating element is exposed to ullage air, while nonetheless collectively providing the sufficient amount of heat to the ambient area if the heating element is immersed in water.

As should be apparent in view of the present disclosure, selection of the collective active period length and the intermittent inactive period length will depend on the particular system conditions, for example (a) the heating characteristics of the heating element(s), (b) the heat transfer characteristics between the heating element(s) and water/ullage air, (c) the heat transfer characteristics between the heating element assembly(ies) in the assembled water heater system and components in the assembled water heater system that may be susceptible to heat damage, and (d) the heat susceptibility of such water heater system components. With regard to the last of the listed factors, for example, a water heater having a tank wall made of a polymer material may be more susceptible to heat damage than a water heater having tank walls made of metal, although both may be susceptible to some degree. Accordingly, in a method of calibrating the example system's operation, the system manufacturer or designer determines a minimum temperature that the heating element(s) may be allowed to reach without damaging either the heating element or other water heater system components, for a given heating element and suite of system components in an assembled water heater system. This may be the maximum allowable heating element temperature, although in certain embodiments the maximum allowable heating element temperature is some temperature magnitude below the absolute maximum temperature, to allow for system and environmental variations. The designer also selects a target water temperature increment by which it is desired to change the water temperature through actuation of the heating element(s) during the test, and determines the amount of time needed for the heating element(s) to contribute that amount of heat to the ambient water when the heating element(s) is/are immersed in water in the assembled water heater. The designer then actuates the heating element when exposed to air, for the needed time, determines the heating element temperature and/or adjacent air temperature at the conclusion of the needed time, and determines if the heating element and/or air temperature is at or above the maximum allowable heating element and/or air temperature. If not, then use of the intermittent heating periods may be omitted in operation of the heating element(s). If so, however, the designer executes a series of simulations, introducing intermittent cool-down periods within the overall heating element actuation over the dry fire test, measuring heating element and/or ullage air temperature at the end of each simulation (i.e. when the heating element(s) has/have been actuated for a total time equal to the needed time) and increasing the intermittent cool-down time in each simulation until a simulation results in a measured heating element and/or air temperature at the end of the simulation that is below the maximum allowable heating element and/or air temperature. The starting point simulation conditions, i.e. of the number of intermittent cool down periods and their length (and, assuming even intermission within the overall actuation period, the corresponding length of the intermittent actuation periods) are selected by the designer in the designer's discretion.

It will also be noted that the water heater system's construction may impact the construction of control system 200. For example, in the presently described embodiments, tank wall 102 and liner 103 are constructed of a polymer material. Since polymers are not good conductors of heat, the temperature sensor in these embodiments (thermistor 152) is disposed in an area ambient to the heating element that is within the water tank interior. In embodiments in which the tank wall is made of metal, however, the control system temperature sensor may be disposed on or within the tank, head, or pan walls, exterior to the water tank interior but adjacent a portion of the water tank interior that is ambient to the upper heating element. In such embodiment, the metal tank wall may sufficiently conduct heat that the method described herein can be implemented by reliance on the wall-conducted heat, without need to install the temperature sensor within the tank interior. In such an embodiment, the calibration method would be similar to that discussed above, but for the different physical arrangement.

Figure 7:
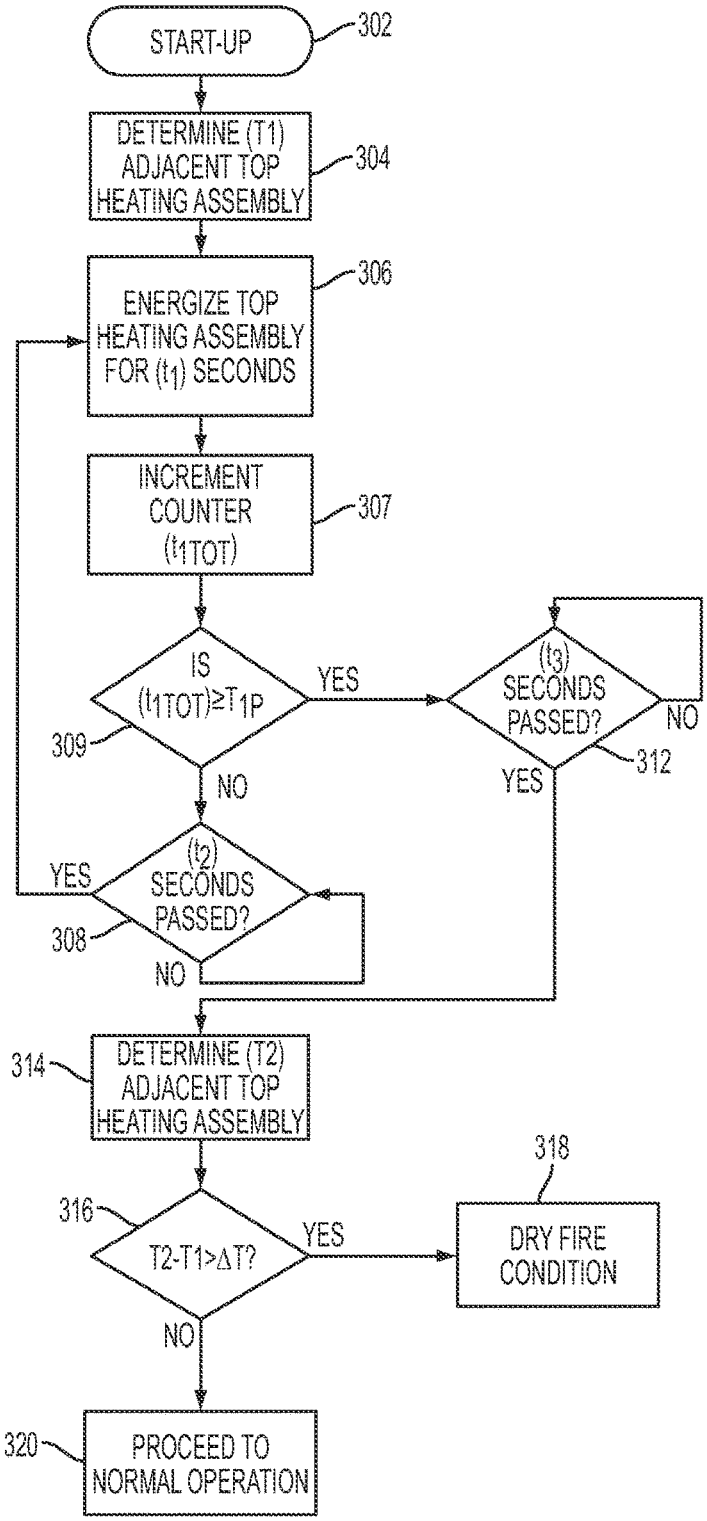
FIG. 7 illustrates a method of detecting and preventing dry fire events as executed by the control system of FIG. 6 as part of the water heaters of FIGS. 1-3.

FIG. 7 illustrates a method of detecting and/or preventing a dry fire event within water heater 100. A start-up event (302) occurs, for example, immediately upon the water heater's initial activation following the water heater's installation, or at an initial activation of water heater 100 following any power-off condition, or upon detection by controller 202 of any condition requiring the application of power to electric resistance heating assemblies 130*a* and 130*b* to bring the temperature of the water mass disposed within water heater 100 to a target temperature during normal operations (e.g. by the controller's monitoring of a signal from temperature sensor probe 150 indicating temperature of water in the tank has fallen to or below the low threshold). In one embodiment, e.g., the dry fire test described herein is executed at the first detection by controller 202 of a temperature from temperature sensor probe 150 requiring activation of the heat assembly(ies) (i.e. at the occurrence of the first heat demand) following system power-up, and in such circumstances, step 302 should be understood to represent occurrence of such a first heat demand. Upon occurrence of step 302, controller 202 determines, at 304, a first temperature (T1) within water heater 100 based upon the controller's receipt of a signal from temperature sensor probe 150 (and, more specifically, from thermistor 152) that is a part of the top heating assembly 130*a*. As should be understood in view of the present disclosure, the thermistor output signal corresponds to temperature detected by the thermistor (and probe 150 generally) in a manner provided by the component manufacturer or determined by calibration, so that controller 202 is programmed to convert the output signal to a temperature, whether by an actual mathematical conversion or by simply a direct association of signal level, or other signal characteristic, to temperature. Note that, for the determination of whether dry fire conditions exist within water heater 100, the presently-described embodiment receives input from the temperature sensor probe of the top electric resistance heating assembly 130*a* but not necessarily from heating assembly 130*b*, although in other embodiments temperature sensor probes may be placed in both heating assemblies and monitored. As it is the vertically highest heating element assembly when the water heater is in its operational position, assembly 130*a* will be the first heating assembly to be uncovered during a low water, or dry fire, condition.

Next, controller 202 sends a signal to switching unit 206, causing top electric resistance heating assembly 130*a* to be energized by power supply 204 for a first predetermined time period (t1) (306), at the conclusion of which controller 202 controls switch unit 206 to cease electric current flow to heating assembly 130*a*, thereby de-energizing the heating assembly. The first predetermined time period (ti) in certain embodiments is between about 0.5 to about 1.5 seconds and about 1.0 seconds in the presently-described embodiment. Upon conclusion of the initial time period (ti) and passage of a second predetermined time period (12) (308), controller 202 then energizes electric resistance heating assembly 130*a* for a subsequent first predetermined time period (ti). The second predetermined time period (12) is about fifteen to about twenty-five seconds in duration in the presently described embodiments, and about twenty seconds in one embodiment. Controller 202 repeats the cycle of energizing heating assembly 130*a* for a first predetermined time period (ti) and subsequently waiting for a second predetermined time period (12) until heating assembly 130*a* has been energized in such cycles a predetermined number of times, so that the heating element's total time of actuation through the test period is sufficient to contribute enough heat to water surrounding the heating element to raise the water's temperature by the desired temperature increment. The desired temperature increment may be the temperature increment determined at the calibration procedure described above, or the calibrated increment plus a tolerance amount, but in either case corresponding to the calibrated temperature increment.

More specifically, controller 202 increments a counter (tnOT) (initialized to zero at step 302) at step 307, after de-energization of heating assembly 130*a* at step 306, so that (tnOT) represents the total number of first predetermined time periods following start-up at 302 for which controller 202 energizes electric resistance heating assembly 130*a* via actuation of switching unit 206. At 309, controller 202 compares the total number of first predetermined time periods (tnOT) to a predetermined number of first predetermined time periods (tiP) (310) that is stored in memory (at the water heater's control board and/or remote from the controller and the board). (tiP) corresponds to from four and six first predetermined time periods in the presently described embodiments, and five first predetermined time periods in one embodiment. If, at 309, (tnOT) has not reached the limit (tiP), controller 202 executes a timer at 308 for a second predetermined time period, 12.

After the total number of first predetermined time periods (tnOT) is equal to or greater than the predetermined number (tiP) stored in memory, controller waits a third predetermined time period (13) (312) prior to determining a second temperature (T2) (314) of the water within the water heater in response to a second signal sampled from temperature sensor probe 150. The third predetermined time period (13) is preferably from about sixty to about eighty seconds in duration, and about seventy seconds in one embodiment. Next, controller 202 compares the second temperature (T2) to the first temperature (T1) (316), and prevents (via control of switching unit 206) the supply of power from power source 204 to electric resistance heating assemblies 130*a* and 130*b* if the second temperature (T2) exceeds the first temperature (T1) by at least a predetermined temperature value (AT) (318). Switching unit 206 thus remains in an open state. Controller 202 may be configured to maintain switching unit 206 in the open state until the water heater is deactivated and then reactivated, i.e. until the next power-down and power-up cycle occurs, at which time the dry-fire test repeats. The predetermined temperature value (AT) is from about three to about five degrees in the presently described embodiment(s), and is about four degrees in one embodiment. If, however, the second temperature (T2) does not exceed the first temperature (T1) by the predetermined temperature value (!::..T), controller 202 actuates switching unit 206 to supply power to electric resistance heating assemblies 130*a* and 130*b*, as occurs during typical water heating operations of the water heater (320). A temperature difference less than the predetermined value (!::..T) indicates that heat is being properly dissipated from the heating assemblies, indicating that the heating assemblies are immersed in water and, therefore, no dry fire conditions exist.

While one or more preferred embodiments of the invention are described above, it should be appreciated by those skilled in the art that various modifications and variations can be made in the present invention without departing from the scope and spirit thereof. For example, alternate embodiments of composite wall panels in accordance with the present disclosure may have fewer, or more, layers than the number of the discussed embodiments. It is intended that the present invention cover such modifications and variations as come within the scope and spirit of the appended claims and their equivalents.

What is claimed is:

1. A water heater, comprising:

a tank defining an interior volume;

a heating element disposed within the interior volume;

a temperature sensor disposed with respect to the heating element so that the temperature sensor detects a temperature of an area ambient to the heating element in the interior volume; and a controller in communication with the temperature sensor and configured to actuate the heating element at a predetermined actuation rate and for a cumulative actuation period so that the predetermined actuation rate maintains the heating element below a predetermined maximum temperature in air and so that upon conclusion of the cumulative actuation period, the heating element contributes at least a predetermined amount of energy to the area that is measurable by the temperature sensor when the heating element is immersed in water.

2. The water heater as in claim 1, wherein the controller is configured to receive a first signal from the temperature sensor indicating the temperature of the area ambient to the heating element and determine a first temperature based on the first signal, after determining the first temperature, intermittently actuate the heating element for the cumulative actuation period, after the cumulative actuation period, receive a second signal from the temperature sensor indicating the temperature of the area ambient to the heating element and determine a second temperature based on the second signal, and disable the heating element if the second temperature exceeds the first temperature beyond a first predetermined increment.

3. The water heater as in claim 2, wherein, at the intermittently actuate step, the controller is configured to intermittently actuate the heating element for a plurality of actuation periods, the plurality of actuation periods being of a same duration.

4. The water heater as in claim 2, wherein, at the intermittently actuate step, the controller is configured to intermittently actuate the heating element for a plurality of actuation periods, and wherein a cumulative duration of the actuation periods is a period of actuation sufficient to heat water ambient to the heating element by at least a second predetermined increment.

5. The water heater as in claim 4, wherein the first predetermined increment defines a temperature threshold that corresponds to the second predetermined increment.

6. The water heater as in claim 4, wherein respective inactive periods of the heating element separating the actuation periods are of duration and frequency sufficient to maintain the heating element below a predetermined maximum temperature.

7. The water heater as in claim 1, wherein the heating element and the temperature sensor are housed in a harness, and wherein the harness is secured to a wall of the tank.

8. The water heater as in claim 1, wherein the temperature sensor is disposed within the interior volume of the tank.

9. The water heater as in claim 7, wherein the temperature sensor and the heating element both extend from the harness in the interior volume within the tank.

10. A controller for a water heater, the controller in communication with a temperature sensor disposed to detect a temperature of an area ambient to a heating element, the controller configured to:

actuate the heating element at a predetermined actuation rate and for a cumulative actuation period so that the predetermined actuation rate maintains the heating element below a predetermined maximum temperature in air and so that upon conclusion of the cumulative actuation period, the heating element contributes at least a predetermined amount of energy to the area that is measurable by the temperature sensor when the heating element is immersed in water.

11. The controller as in claim 10, wherein the actuating step comprises:

detecting a first temperature of the area ambient to the heating element;

after detecting the first temperature, intermittently actuating the heating element for a predetermined cumulative actuation period;

after the predetermined cumulative actuation period, determining a second temperature of the area ambient to the heating element; and disabling the heating element if the second temperature exceeds the first temperature beyond a first predetermined increment.

12. The controller as in claim 11, wherein the intermittently actuating step comprises intermittently actuating the heating element for a plurality of actuation periods, the plurality of actuation periods being of a same duration.

13. The controller as in claim 11, wherein the intermittently actuating step comprises intermittently actuating the heating element for a plurality of actuation periods, and wherein a cumulative duration of the actuation periods is a period of actuation sufficient to heat water ambient to the heating element by at least a second predetermined increment.

14. The controller as in claim 13, wherein the first predetermined increment defines a temperature threshold that corresponds to the second predetermined increment.

15. The controller as in claim 13, wherein respective inactive periods of the heating element separating the actuation periods are of duration and frequency sufficient to maintain the heating element below the predetermined maximum temperature.

16. The controller as in claim 13, wherein the temperature sensor is located within a tank of the water heater.

* * * * *